US007208045B2

(12) United States Patent
Platsch

(10) Patent No.: US 7,208,045 B2
(45) Date of Patent: Apr. 24, 2007

(54) POWDERING UNIT, POWDERING STATION AND METHOD FOR THEIR OPERATION

(75) Inventor: Hans G. Platsch, Stuttgart (DE)

(73) Assignee: Platsch GmbH & Co KG, Stuttgart (DE)

( * ) Notice: Subject to any disclaimer, the term of this patent is extended or adjusted under 35 U.S.C. 154(b) by 131 days.

(21) Appl. No.: 10/635,620

(22) Filed: Aug. 6, 2003

(65) Prior Publication Data

US 2004/0069220 A1 Apr. 15, 2004

(30) Foreign Application Priority Data

Aug. 17, 2002 (DE) ..... 102 36 264

(51) Int. Cl.

| | |
|---|---|
| ***B05C 19/00*** | (2006.01) |
| ***B05B 7/06*** | (2006.01) |
| ***B41F 23/04*** | (2006.01) |
| ***B41F 23/06*** | (2006.01) |

(52) U.S. Cl. ..... 118/308; 118/325; 118/316; 101/424.2; 101/416.1

(58) Field of Classification Search ..... 118/308, 118/325, 313, 315, 316, 46, 314; 101/416.1, 101/424.2, 424.1, 419–420
See application file for complete search history.

(56) References Cited

U.S. PATENT DOCUMENTS 5,964,155 A * 10/1999 Platsch ..... 101/424.2
6,085,654 A * 7/2000 Gunschera et al. ..... 101/424.2

* cited by examiner

*Primary Examiner*—Yewebdar Tadesse
(74) *Attorney, Agent, or Firm*—Watson IP Group, PLC; Jovan N. Jovanovie; Vladan M. Vasiljevic

(57) ABSTRACT

A powdering unit for spraying printed products with powder has two box-shaped guiding elements following each other in the product-conveying direction. These guiding elements delimit, with mutually opposite parallel guiding sides, a guiding shaft leading to the product-conveying plane and intended for a powder gas curtain and delimit, with guiding sides running substantially parallel to the product-conveying surface, together with one side of the product, a powder gas guiding shaft running parallel to the product surface.

20 Claims, 4 Drawing Sheets

POWDERING UNIT, POWDERING STATION AND METHOD FOR THEIR OPERATION

BACKGROUND OF THE INVENTION

1. Field of the Invention

The invention relates to a powdering unit having a nozzle strip which produces a powder gas curtain containing powder particles distributed in a carrier gas stream, which curtain moves substantially in a curtain plane. It relates furthermore to a powdering station comprising two such powdering units. Furthermore, the invention relates to a method for operating a powdering unit and a powdering station.

2. Background Art

Powdering units are used in the printing industry to spray the ink films of printed products which have not yet fully dried with a very fine powder (organic or inorganic) and thus prevent the printed products from sticking together via the ink layers when they are laid on top of one another to form a stack. In the event of blocking between successive printed products via the ink layers, the ink layers would be damaged on separating the individual printed sheets again, rendering the printed products unusable.

In the known powdering units, a powder gas produced in a separate generator and containing powder particles suspended in a carrier gas stream is delivered via a nozzle strip having a multiplicity of nozzles of substantially the same orientation spaced apart in the longitudinal direction of the strip. The nozzle strip thus produces a powder curtain which is substantially homogeneous at a certain distance from the nozzle strip and through which the printed products to be sprayed with powder are moved with a conveying direction substantially perpendicular to the mean direction of the powder curtain.

The powder curtain diverges substantially in a wedge shape from the nozzle strip. The mid-plane of this powder gas curtain is referred to hereinbelow and in the claims as curtain plane for short.

In such powdering units, it is sought first of all to guide the powder curtain in such a way that as many as possible of the powder particles entrained in the carrier gas stream come into intimate contact with the ink layer of the printed product and adhere to the ink layer when and where the latter is still tacky.

By means of the present invention, a powdering unit having a nozzle strip which produces a powder gas curtain containing powder particles distributed in a carrier gas stream, which curtain moves substantially in a curtain plane, is to be developed in such a way that an even better adherence of the powder particles to the surface of the products to be sprayed with powder is ensured.

SUMMARY OF THE INVENTION

This object is achieved according to the invention by means of a powdering unit having a nozzle strip which produces a powder gas curtain containing powder particles distributed in a carrier gas stream, which curtain moves substantially in a curtain plane, and wherein, the powder curtain moves between two angled guiding elements each having a first guiding side arranged parallel to each other or coplanar, and each having a second guiding side running parallel to the powder curtain plane.

In the powdering unit according to the invention, under use conditions, the first sides of the guiding elements form guiding walls which run at a distance from and parallel to the conveying surface of the products to be sprayed with powder. This ensures that the powder gas stream is held together over a certain distance of the conveying path of the products, in the direction perpendicular to the product-conveying direction. As a result, the powder particles have a longer opportunity to settle on the product surface.

Furthermore, the second sides of the guiding elements form a laterally delimited guiding channel which extends from the nozzle strip into the vicinity of the product-conveying plane. Consequently, the powder gas stream is also laterally held together on its way from the nozzle strip to the product surface.

The two guiding elements at the same time have the effect that less unused powder results, and in particular that such unused powder does not collect at places adjacent to the nozzle strip of the printing machine in which the powdering unit is arranged.

Advantageous developments of the invention are specified in further preferred embodiments.

In particular, in one preferred embodiment, wherein the second sides form an angle differing from 90° with the first sides, it is possible to give the incoming powder gas stream guided between the second guiding sides a velocity component in the conveying direction of the products, depending on the setting of the second guiding sides in, or counter to, the product-conveying direction. This too is advantageous with regard to achieving as high an adherence rate of the powder particles as possible. It is also possible to use the setting angle of the second guiding sides to influence the proportions of the powder gas stream which are guided, respectively, in the conveying direction of the products and counter to the product-conveying direction, along the product surface.

In another preferred embodiment, the end of at least one of the second guiding sides which is remote from the first side is connected to a carrying side which is perpendicular to this second guiding side and on which the nozzle strip is mounted. In such an embodiment, an alignment of the curtain plane and guiding channel which is formed by the second guiding sides of the guiding elements is obtained in a simple manner.

In another preferred embodiment, the corresponding guiding elements are closed, box-shaped structures, which is advantageous with regard to keeping the guiding elements clean.

In yet another preferred embodiment, the box-shaped guiding elements can be additionally used to suck off excess powder gas in a controlled manner, so that it does not escape into the interior of the printing machine.

In such an embodiment described above, the suction slot is adjacent to the free end of the first guiding side. In another such embodiment, the second box-shaped guiding element is connected to a suction fan and its first guiding side delimits a suction slot. In one such embodiment, the suction slot is adjacent to that end of the first guiding side which is remote from the second guiding side. With any such embodiment, a long time of action of the powder gas on the product surface is obtained in this way.

In another embodiment, a substantially coplanar extension is provided for the first guiding side of at least one of the guiding elements. With such a development of the invention, the effect achieved is that a laminar blocking air stream is moved respectively from the downstream and upstream side of the guiding elements to the suction slots. Such a stream directed parallel to the product surface blocks the escape of unused powder gas particularly effectively and at the same time detaches only a few powder particles which have previously settled on the product surface.

In another preferred embodiment, a lead-in sloping surface is provided at that end of the first guiding side of at least the upstream guiding element which is remote from the second guiding side. Such a development makes it possible to choose a relatively small distance between the first guiding sides of the guiding elements and the product-conveying plane and nevertheless to ensure that the leading edges of the printed products do not strike against the powdering unit.

In another preferred embodiment, a housing surrounding guiding elements and the nozzle strip. Such a development is advantageous with regard to achieving a smooth-surfaced exterior of the powdering unit and to keeping clean the interior of the printing machine in which the powdering unit is arranged.

In a preferred embodiment, the powdering station may include two powdering units which are arranged on opposite sides of a conveying plane for products to be sprayed with powder. Using such a powdering station, the powdering of fresh printed products on both sides can be accomplished. This gives greater reliability of good re-separation of a printed sheet from a stack, since between two superposed printed products there are two powder layers, one on the bottom side of the printed product above and one on the top side of the printed product below.

An influence, due to the flow of air, on the conveyance of the products to be sprayed with powder is also brought about by a powdering unit. Wherein the two powdering units are substantially aligned with each other as seen in the conveying direction of the products, the effect achieved is that these influences are symmetrical from both sides of the product-conveying plane, so that they are accentuated at least to some extent.

In one such preferred embodiment, the two guiding sides of the powdering unit cooperate with the bottom side of the products to be sprayed with powder are at a greater inclination with respect to the normal of the product-conveying plane than the second guiding side of the powdering unit cooperating with the top side of the products. With such an arrangement, the effect achieved is that one nozzle strip (in practice the one remote from the path of the grippers pulling along the products) can move somewhat closer to the product-conveying plane. Consequently, for this powdering unit, an even better powdering result is obtained.

If a powdering unit or a powdering station is operated wherein the air quantity drawn off via the guiding elements in the form of boxes is about 10 to 40 times, preferably 20 to 30 times, that of the powder gas quantity delivered by the nozzle strip, on the one hand a good blocking action against escape of powder gas is achieved, and on the other hand the extent to which powder particles which have already settled on the products to be sprayed with powder are blown off again is small at worst.

In one embodiment, the air quantities drawn off by the guiding elements are adjustable at least to some extent. With such an embodiment, undesired design-related dissymmetries in the flow conditions of the various guiding elements can be eliminated or conversely such flow differences can if desired also be produced if the geometric conditions of the various guiding elements are the same.

BRIEF DESCRIPTION OF THE DRAWINGS

The invention is explained in more detail below using exemplary embodiments with reference to the drawing, in which.

DETAIL DESCRIPTION OF THE DRAWINGS

Figure 1:
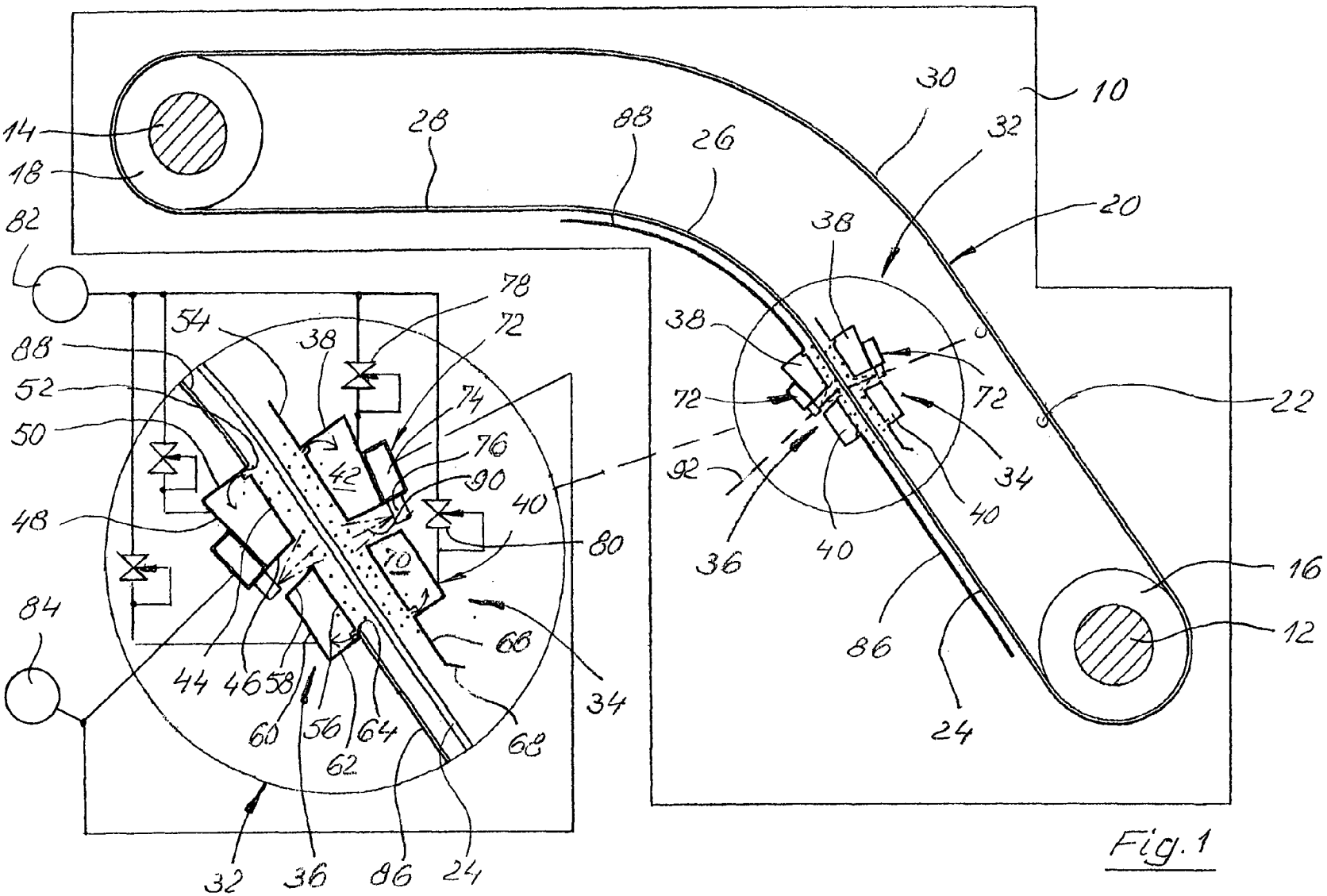
FIG. 1 shows a lateral schematic view of the delivery station of a printing machine having a powdering station for the substantially symmetrical powdering of the top side and bottom side of freshly printed sheets.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

In FIG. 1 the delivery station of a printing machine is depicted highly schematically. To the right of FIG. 1, the various printing stations of the printing machine can be envisaged.

The delivery station has two spaced-apart side plates 10, which are connected to each other by crossmembers (not shown specifically) and support two shafts 12, 14. The shafts 12, 14 carry chain wheels 16, 18 which cooperate with closed chains 20. The latter carry at regular spacings grippers 22, only a few of which are indicated by way of example. The two ends of the grippers 22 are connected to aligned places of the two chains 20 and move on a closed path, as can be seen from FIG. 1.

Starting from the lower chain wheels 16, the chains 20 pass through a rising path section 24, then a path section 26 curving to the left, a horizontal path section 28, where the printed sheets are dropped and, falling one on top of the other, form a stack, and then run around the upper chain wheels 18. A return strand of the chains 20, which is denoted as a whole by 30, returns, substantially parallel to the path sections 24, 26 and 28, to the lower chain wheels 16.

To guide the chains 20 in the path section 26 and the section of the return strand 30 parallel thereto, a plurality of free-running guide wheels or curved guide rails are provided, as known per se, these not being depicted in the drawing.

Provided in the region of the rising path section 24 is a powdering station, denoted as a whole by 32. The latter comprises an upper powdering unit 34 lying above the product-conveying plane and a lower powdering unit 36 substantially symmetrical to the upper powdering unit with respect to the product-conveying plane.

The reference symbols used in the following part of the description are entered partly at the powdering unit 34 and partly at the powdering unit 36, for the sake of clarity of the drawing. It is understood that these reference symbols apply equally to the components, lying symmetrically with respect to the product-conveying surface, of the other powdering unit respectively.

As shown in the detail view of FIG. 1, the upper powdering unit 34 comprises a downstream guiding box 38 and an upstream guiding box 40.

The guiding box 38 is a prismatic sheet-metal part which is closed at its longitudinal ends by end walls 42.

The peripheral wall of the guiding box 40 comprises a first guiding side 44 which runs parallel above the product-conveying surface. Adjoining the first guiding side 44 is a second guiding side 46, which forms an angle of about 95 to 100° with the first guiding side 44.

Adjoining the second guiding side 46 is a carrying side 48 which runs perpendicularly to the upper end of the second guiding side 46. That end of the carrying side 48 lying at the top in FIG. 1 is led back into the vicinity of the free end of the first guiding side 44 via an outer side 50 running perpendicularly to the product-conveying surface.

The free, upper end of the first guiding side 44 is folded inwards by 90° , so that between the lower end of the outer side 38 and the inwardly folded end section of the first guiding side 44 a suction slot 52 is delimited.

Adjoining the lower end of the outer side 38 is an extension arm 54 which lies in the same plane as the first guiding side 44.

The sides 44, 46, 48, 50 and the arm 54 can in practice be formed by a single appropriately bent sheet-metal part, and the prismatically tubular body thereby formed is closed at its ends by the end walls 42 to form a box, as already mentioned above.

The upstream guiding box 40 comprises a first guiding side 56 which runs parallel to the product-conveying surface and lies in the same plane as the first guiding side 44 of the first guiding box 38.

Adjoining the upper end of the first guiding side 56 is a second guiding side 58 which forms an angle of 85–80° with the plane of the first guiding side 56 and runs parallel to the second guiding side 46 of the first guiding box 38. The upper end of the second guiding side 58 is aligned with the upper end of the second guiding side 46.

From the upper free end of the second guiding side 58 there extends parallel to the product-conveying surface an upper covering side 60, and adjoining the lower free end of the latter is an outer side 62 which leads substantially back to the free, lower end of the first guiding side 44. An end section of the first guiding side 56 is again folded inwards by 90° , so that between the first guiding side 56 and the outer side 62 a suction slot 64 is delimited.

Adjoining the outer side 62 is an extension arm 66 which runs parallel to the product-conveying surface and is coplanar with the first guiding side 56. The extension arm 66 has at its free end an obliquely outwardly running lead-in section 68.

The tubularly prismatic body formed by the sides 56, 58, 60 and 62 is again closed at its ends by end walls 70 and thus forms a closed box.

Arranged on the carrying side 48 of the first guiding box 38 is a nozzle strip, denoted as a whole by 72. The latter comprises a distribution channel 74 which has a rectangular cross-section and one side face of which constitutes an extension of the second guiding side 46. Seated on this side face of the distribution channel 74 in a manner spaced apart evenly perpendicularly to the plane of the drawing of FIG. 1 are nozzle heads 76, the nozzle openings of which run perpendicularly to the head axis and are all oriented parallel, perpendicularly to the mounting surface of the distribution channel 74.

The spacing between the two guiding boxes 38 and 40 is chosen such that the plane defined by the axes of the nozzle heads 76 lies midway between the two guiding sides 46 and 58.

The interior of the guiding boxes 38, 40 is connected via separate pressure-regulating valves 78, 80 (or flow regulators) to a suction machine 82, indicated merely schematically. The interior of the distribution channel 74 is connected to a schematically illustrated powder gas source 84 which produces a powder gas stream containing very fine powder particles suspended in a carrier gas. The powder particles may be lime or maize particles and may have a diameter of the order of 1 μm.

The second powdering unit 36, which lies below the product-conveying plane, has substantially the same construction as described above for the powdering unit 34. There is thus no need to describe it again in great detail.

In the powdering unit 36, no extension arms are formed on the outer sides 50, 62, but rather the outer sides 50, 62 are joined to the ends of two sheet-guiding plates 86, 88 which extend over the lower part of the path section 24 and the path section 26, respectively.

The above-described powdering station works as follows:

The nozzle strips 72 are supplied with a powder gas stream from the powder gas source 84. From the nozzle heads 76 there emerge powder gas jets which overlap at the latest at the lower end of the guiding sides 44, 46 and form a powder curtain, denoted as a whole by 90 in the drawing. The curtain plane defined by the axes of the nozzle heads 76 is indicated at 92.

If a printed product is in front of the powdering units 34, 36, a first part of the powder curtain 90 flows upwards between the first guiding side 44 and the top side of the product (or for the powdering unit 36: the bottom side of the product). In the process, the powder particles suspended in the powder gas stream come into contact with the product surface and adhere to it, as long as the ink film is still tacky.

Since the interior of the guiding boxes 38 is subjected to negative pressure, on the one hand air is sucked in through the suction slot 52 from that space which lies between the extension arm 54 and the top side of the product (or the rear side of the product). This air stream blocks the passage between the extension arm 54 and the top side of the product (or the rear side of the product) for the powder gas stream. The powder gas stream arriving at the upper end of the rising guiding shaft formed by the first guiding side 44 and the top side of the product (or the rear side of the product) is sucked in via the suction slot 52.

Correspondingly, the second part of the powder gas stream flows from the lower end of the supply guiding shaft, which is delimited by the second guiding sides 46, 58, through a falling guiding shaft, which is delimited by the first guiding side 56 and the top side of the product (or the rear side of the product), along the top side (or rear side) of the printed products, where powder particles are deposited.

As explained above for the powdering unit 34, between the extension arm 66 and the top side of the product (or the upper end of the sheet-guiding plate 86 and the rear side of the product) a blocking air stream is sucked into the outlet slot 64. Excess powder gas is thus sucked off via the interior of the guiding box 40.

It will be appreciated that, through the size of the angle at which the second guiding sides 46, 58 are tilted away from a direction perpendicular to the product-conveying plane, it is possible to adjust the proportions of the powder gas stream which run, respectively in the product-conveying direction and counter to the product-conveying direction, along the surface of the printed product until they are sucked off via the suction slots 52, 64 of the guiding boxes 38, 40.

Figure 2:
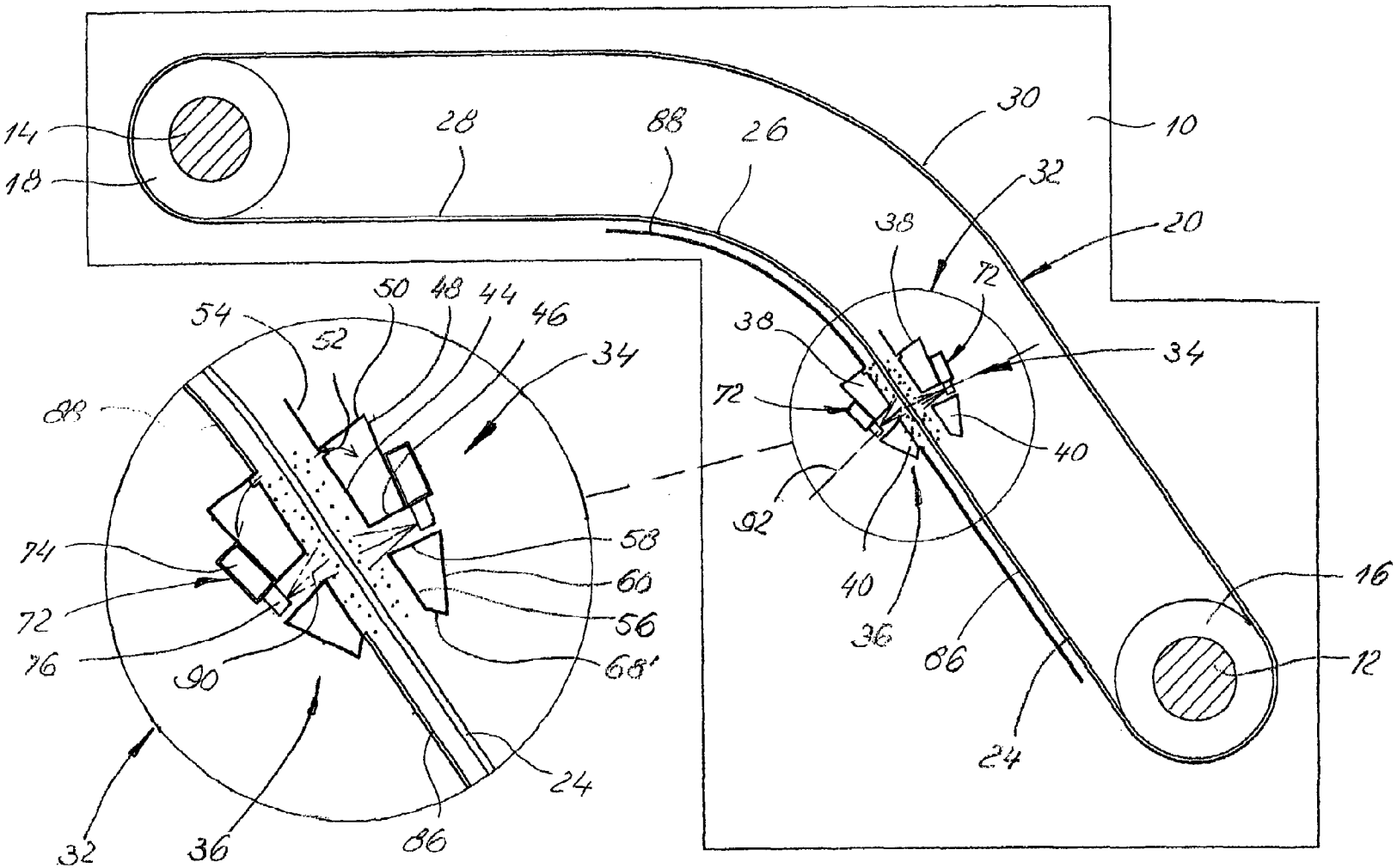
FIG. 2 shows a similar view to FIG. 1, in which a modified simplified powdering station is illustrated.
Figure 3:
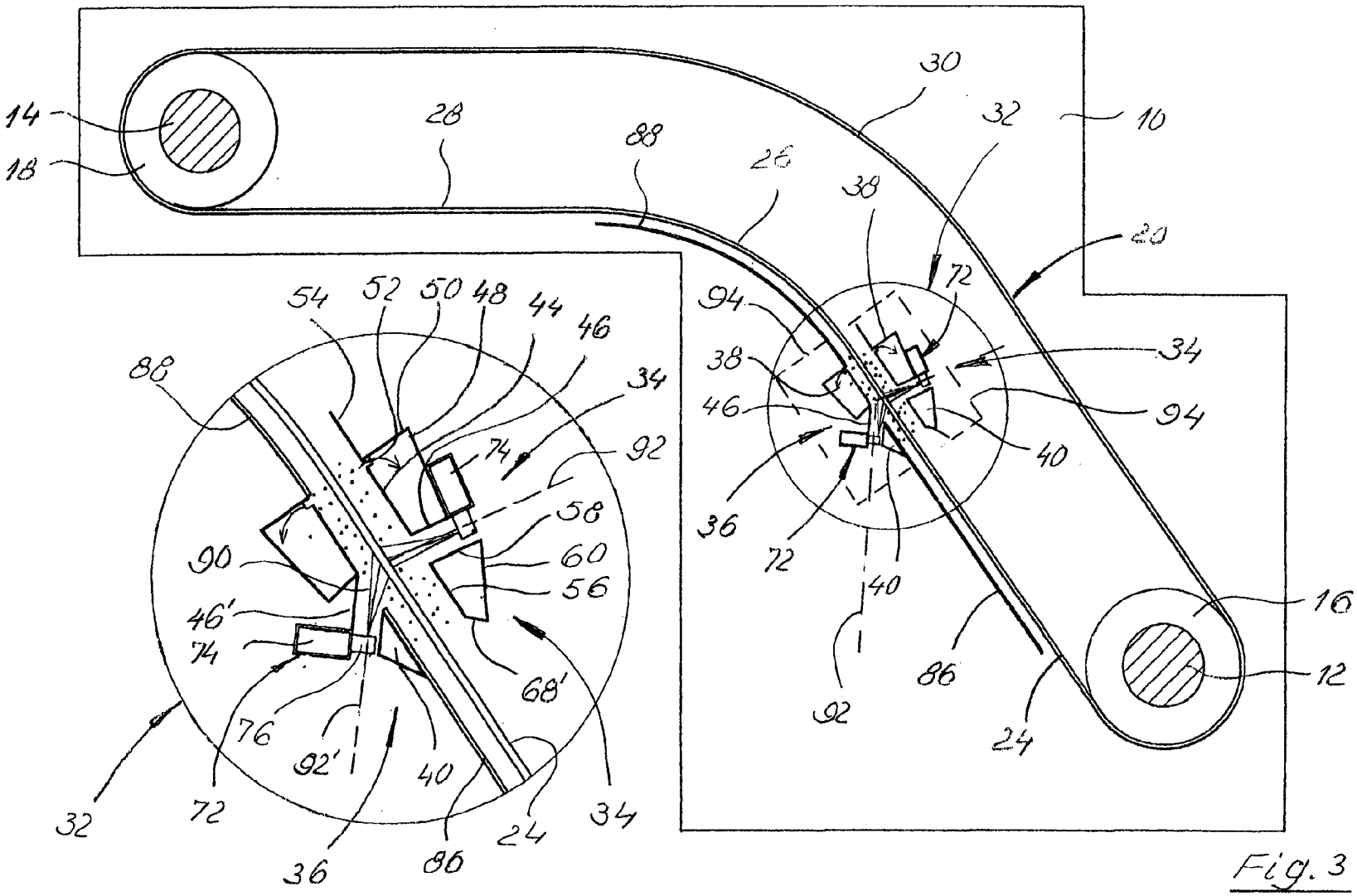
FIG. 3 shows a similar view to FIG. 2, in which a further simplified powdering station is shown.
Figure 4:
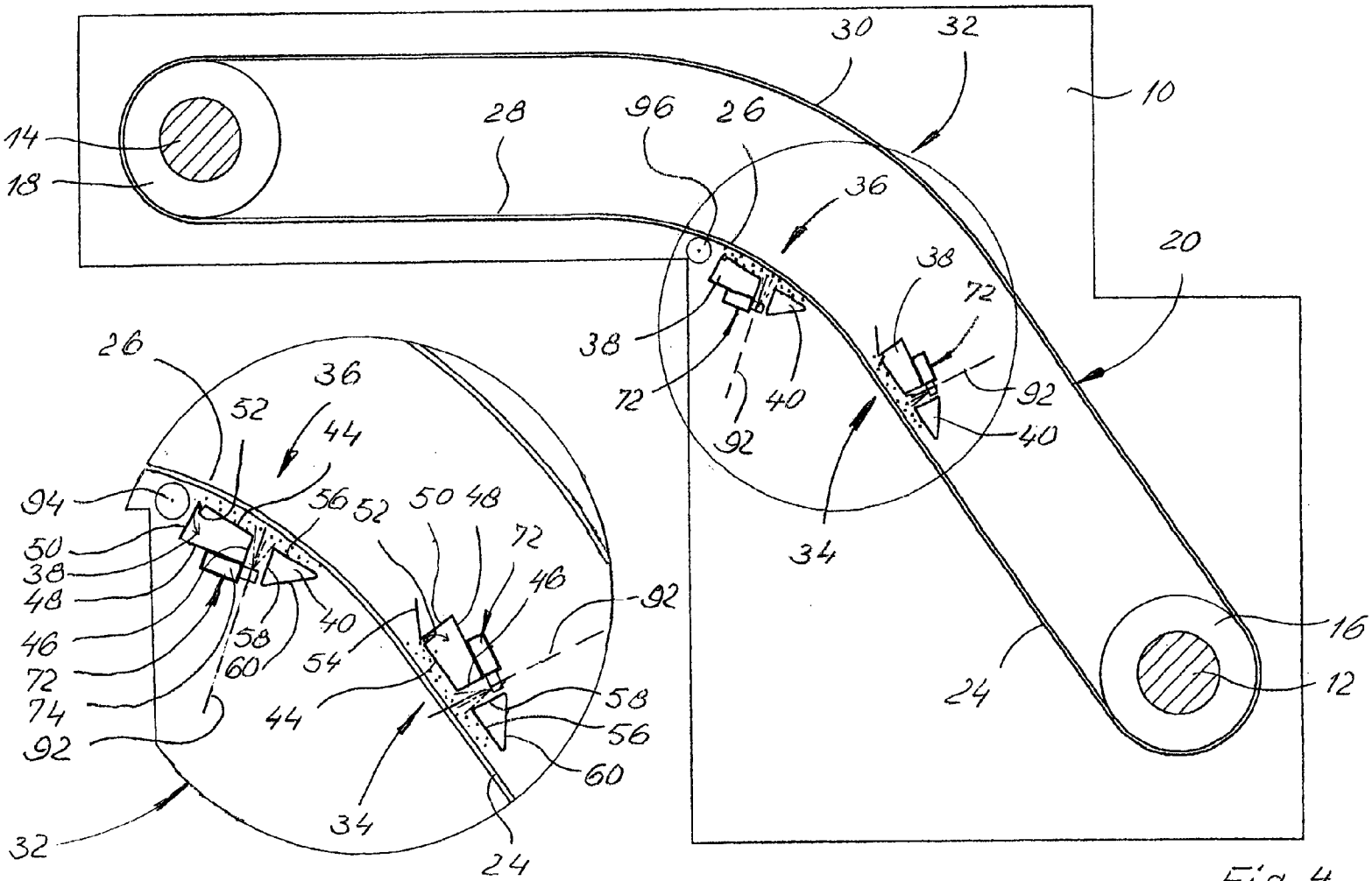
FIG. 4 shows a similar view to FIG. 3, in which the arrangement is further simplified and the two powdering units for the top side and bottom side of the printed sheets are offset from each other in the product-conveying direction.

In FIGS. 2 to 4, details which are not necessary to explain the differences of these exemplary embodiments from the exemplary embodiment according to FIG. 1 are omitted for simplicity.

The exemplary embodiment according to FIG. 2 differs from that according to FIG. 1 in that the second guiding box 40 is not designed as a suction box. Furthermore, the lead-in section 68 is replaced simply by a sloping surface 68' at the upstream end of the guiding box 40. The latter no longer has an extension arm 66.

In the exemplary embodiment according to FIG. 3, the setting angle of the second guiding side 46 for the lower powdering unit 36 is at a greater inclination perpendicularly to the product-conveying surface. Consequently, the nozzle strip 72 of the lower powdering unit 36 is arranged closer, which is made possible by the fact that the grippers holding the printed sheets do not get in the way at that point, while maintaining the same distance from the point of impact of the powder curtain 90 on the printed product but achieving a greater glancing incidence.

The guiding side 46 is now also no longer a delimiting wall of the guiding box 38 but is attached to the latter. The lower nozzle strip 72 is fastened to the upper end of the second guiding side 46, as a result of which the correct alignment with respect to the curtain plane 92 for the rectangular cross-sectional shape of the distribution channel 74 is likewise ensured.

The upstream guiding box 40 of the lower powdering unit 36 is designed with a triangular profile for its peripheral wall.

The upper powdering unit 34 corresponds to that according to FIG. 2.

In FIG. 3, a smooth-surfaced cuboid-like housing is indicated at 94 by dashed lines in each case, which housing surrounds the guiding boxes and the nozzle strip of a powdering unit.

In the exemplary embodiment according to FIG. 4, both powdering units 34, 36 are of similar design to that described for the lower powdering unit 36 of FIG. 3. The inclination of the second guiding sides 46, 58 is, however, now again chosen to be the same for both powdering units 34, 36 and is respectively 95–100° and 85–80°, as described above.

The arrangement according to FIG. 4 has the advantage that the powdering of the bottom side of the printed products takes place at a later time, so that the powder has less opportunity to fall off under gravity before the dropping of the printed sheet, which takes place in the horizontal path section 28. In addition, the deposited powder can be somewhat pressed against the bottom side of the printed sheets and thus adhere better when the bottom side of the printed sheets runs over a braking roller (sheet brake) 94, indicated schematically in FIG. 4.

Hereinabove, the powdering units have been described in connection with the rising delivery section of a printing machine. As can be readily inferred from FIG. 4, however, the powdering units can also be arranged on curved conveying-path regions for the printed sheets, in particular also in transfer regions between cylinders and rollers close to the outlet of printing units.

Hereinabove, the powdering units and powdering stations have been described with reference to use in a printing machine. It goes without saying that the powdering units and powdering stations can also be used in other machines in which it is desired to render a tacky product surface non-tacky or to facilitate re-separation of stacked products. Corresponding applications are found in the production of plastic films but also in the production of glass products.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A powdering unit comprising:

a nozzle strip which produces a powder gas curtain containing powder particles distributed in a carrier gas stream, which powder gas curtain moves substantially in a curtain plane, wherein the powder gas curtain moves between two angled powder guiding elements each having a first powder guiding side arranged at least one of parallel to each other and coplanar, and each having a second powder guiding side running parallel to the powder gas curtain plane at least one of the second powder guiding sides which is remote from the first powder guiding side is connected to a carrying side which is perpendicular to the second powder guiding side and on which the nozzle strip is mounted, an end of the carrying side which is remote from the second powder guiding side is connected via an outer side to an end of the first powder guiding side which is remote from the second powder guiding side, and a resulting prismatic wall obtained overall in this way is closed at the ends thereof by end parts to form a box.

2. The powdering unit according to claim 1, wherein the second powder guiding sides form an angle differing from 90° relative to the first powder guiding sides.

3. The powdering unit according to claim 1, wherein a substantially coplanar extension is provided for the first powder guiding side of at least one of the powder guiding elements.

4. The powdering unit according to claim 1, wherein a housing surrounds powder guiding elements and nozzle strip.

5. A powdering station, having two powdering units according to claim 1, the two powdering units are arranged on opposite sides of a conveying plane for a product to be sprayed with powder.

6. The powdering station according to claim 5, wherein the two powdering units are substantially aligned with each other as seen in a conveying direction of a product.

7. The powdering station according to claim 5, wherein the first and second powder guiding sides of the powdering unit cooperating with a bottom side of a product to be sprayed with a powder are at a greater inclination with respect to a normal of a product-conveying plane than the second powder guiding side of the powdering unit cooperating with a top side of a product to be sprayed with a powder.

8. The powdering unit according to claim 1, wherein an air quantity drawn off via the first and second powder guiding elements each in the form a box is about 10 to 40 times that of a powder gas quantity delivered by the nozzle strip.

9. The powdering unit according to claim 1, wherein the air quantity drawn off by the powder guiding elements are at least partially adjustable.

10. The powdering unit according to claim 1, wherein the air quantity drawn off via the first and second powder guiding elements each in the form of a box is about 20 to 30 times that of a powder gas quantity delivered by the nozzle strip.

11. A powdering unit comprising:

a nozzle strip which produces a powder gas curtain containing powder particles distributed in a carrier gas stream, which powder gas curtain moves substantially in a curtain plane, wherein the powder gas curtain moves between two angled powder guiding elements each having a first powder guiding side arranged at least one of parallel to each other and coplanar, and each having a second powder guiding side running parallel to the powder gas curtain plane at least one of the second powder guiding sides which is remote from the first powder guiding side is connected to a carrying side which is perpendicular to the second powder guiding side and on which the nozzle strip is mounted, wherein there is connected to the second powder guiding side, which does not carry a nozzle strip, a covering side which is connected, one of directly and with interposition of an outer side substantially perpendicular to the first powder guiding side, to that end of the first powder guiding side which is remote from the second powder guiding side, and a prismatic wall obtained overall in this way is closed at the ends thereof by end parts to form a box.

12. The powdering unit according to claim 11, wherein the box is connected to a suction fan and the first powder guiding side thereof delimits a suction slot.

13. The powdering unit according to claim 12, wherein the suction slot is adjacent to that end of the first powder guiding side which is remote from the second powder guiding side.

14. A powdering unit comprising:

a nozzle strip which produces a powder gas curtain containing powder particles distributed in a carrier gas stream, which powder gas curtain moves substantially in a curtain plane, wherein the powder gas curtain moves between two angled powder guiding elements each having a first powder guiding side arranged at least one of parallel to each other and coplanar, and each having a second powder guiding side running parallel to the powder gas curtain plane, wherein a lead-in sloping surface is provided at that end of the first powder guiding side of at least an upstream powder guiding element which is remote from the second powder guiding side.

15. A powdering unit comprising:

a nozzle strip which produces a powder gas curtain containing powder particles distributed in a carrier gas stream, which powder gas curtain moves substantially in a curtain plane, wherein the powder gas curtain moves between two angled powder guiding elements each having a first powder guiding side arranged at least one of parallel to each other and coplanar, and each having a second powder guiding side running parallel to the powder gas curtain plane, at least one of the second powder guiding sides which is remote from the first powder guiding side is connected to a carrying side which is perpendicular to the second powder guiding side and on which the nozzle strip is mounted, an end of the carrying side which is remote from the second powder guiding side is connected via an outer side to an end of the first powder guiding side which is remote from the second powder guiding side, and a resulting prismatic wall obtained overall in this way is closed at the ends thereof by end parts to form a box which is connected to a suction fan and the first side thereof delimits a suction slot.

16. The powdering unit according to claim 15, wherein there is connected to the second powder guiding side, which does not carry a nozzle strip, a covering side which is connected, one of directly and with interposition of an outer side substantially perpendicular to the first powder guiding side, to that end of the first powder guiding side which is remote from the second powder guiding side, and a prismatic wall obtained overall in this way is closed at the ends thereof by end parts to form a box.

17. The powdering unit according to claim 16, wherein the box is connected to a suction fan and the first powder guiding side thereof delimits a suction slot.

18. The powdering unit according to claim 17, wherein the suction slot is adjacent to that end of the first powder guiding side which is remote from the second powder guiding side.

19. The powdering unit according to claim 15, wherein the suction slot is adjacent to that end of the of the first powder guiding side which is remote from the second powder guiding side.

20. The powdering unit according to claim 15, wherein a lead-in sloping surface is provided at that end of the first powder guiding side of at least an upstream guiding element which is remote from the second powder guiding side.

* * * * *